US010477290B2

(12) United States Patent
Kuribayashi et al.

(10) Patent No.: US 10,477,290 B2
(45) Date of Patent: Nov. 12, 2019

(54) LOUDSPEAKER DEVICE AND MOVABLE-BODY DEVICE EQUIPPED WITH THE SAME

(71) Applicant: Panasonic Intellectual Property Management Co., Ltd., Osaka (JP)

(72) Inventors: Ryo Kuribayashi, Osaka (JP); Takayumi Daikoku, Osaka (JP); Tetsushi Itano, Osaka (JP); Hirofumi Higashi, Osaka (JP); Hiroyuki Morimoto, Mie (JP); Yohei Jin, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/946,752

(22) Filed: Apr. 6, 2018

(65) Prior Publication Data

US 2018/0310084 A1 Oct. 25, 2018

(30) Foreign Application Priority Data

Apr. 21, 2017 (JP) ..... 2017-084127

(51) Int. Cl.
*H04R 1/02* (2006.01)

(52) U.S. Cl.
CPC ..... *H04R 1/025* (2013.01); *H04R 2201/028* (2013.01); *H04R 2499/13* (2013.01)

(58) Field of Classification Search
CPC . H04R 1/025; H04R 1/02; H04R 1/20; H04R 1/28; H04R 1/2815; H04R 1/2823; H04R 2499/13
USPC ..... 381/86, 302, 71.4, 365, 389
See application file for complete search history.

(56) References Cited

U.S. PATENT DOCUMENTS

| | | | | |
|---|---|---|---|---|
| 4,572,326 | A * | 2/1986 | Hutchins | B60R 11/0217 181/150 |
| 4,819,761 | A * | 4/1989 | Dick | H04R 1/02 181/145 |
| 2010/0074453 | A1 | 3/2010 | Ludwig et al. | |
| 2015/0158432 | A1* | 6/2015 | O'Neal | B60R 11/0217 381/389 |
| 2018/0020290 | A1* | 1/2018 | Ludwig | B60R 11/0217 |

FOREIGN PATENT DOCUMENTS

| | | | | |
|---|---|---|---|---|
| EP | 1713297 | A2 * | 10/2006 | B60R 11/0217 |
| JP | 8-140177 | | 5/1996 | |
| JP | 2012-503940 | | 2/2012 | |

* cited by examiner

*Primary Examiner* — Ahmad F. Matar
*Assistant Examiner* — Sabrina Diaz
(74) *Attorney, Agent, or Firm* — Greenblum & Bernstein, P.L.C.

(57) ABSTRACT

A loudspeaker device includes a loudspeaker unit and an enclosure. The loudspeaker unit outputs sounds mainly in a first direction, upon receiving an electric signal. The enclosure is configured with at least a part of an interior member of a movable-body device, and secures and accommodates the loudspeaker unit in the inside of the enclosure. The interior member includes a body part, and an accommodation part that accommodates the loudspeaker unit therein and is formed integrally with the body part. The accommodation part is larger in dimension along the first direction than the body part.

11 Claims, 5 Drawing Sheets

LOUDSPEAKER DEVICE AND MOVABLE-BODY DEVICE EQUIPPED WITH THE SAME

BACKGROUND

1. Technical Field

The present disclosure relates to a loudspeaker device integrated in an interior member of an automobile and the like, and to device movable-body device equipped with the loudspeaker device.

2. Description of the Related Art

A loudspeaker device for reproducing low-pitched sounds requires a large volumetric capacity for enhancing the ability of the device to reproduce low-pitched sounds. Unfortunately, there is a limit to the space available for such a device in an automobile. Thus, Japanese Translation of PCT Publication No. 2012-503940 (Patent Literature 1, hereinafter), for example, proposes that a spare-wheel housing section, which is disposed in the interior of an automobile, is used as an enclosure of a loudspeaker.

SUMMARY

The present disclosure is intended to provide a loudspeaker device which utilizes an interior member of a movable-body device such as an automobile, as an enclosure of the loudspeaker device. Such a loudspeaker device can feature compatibility between high sound quality in a vehicle interior and space saving of the vehicle interior.

The loudspeaker device according to the present disclosure includes a loudspeaker unit and an enclosure. The loudspeaker unit outputs sounds mainly in a first direction, upon receiving an electric signal. The enclosure is configured with at least a part of the interior member of the movable-body device, and secures and accommodates the loudspeaker unit in the inside of the enclosure. The interior member includes a body part, and an accommodation part that accommodates the loudspeaker unit therein. The accommodating part is formed integrally with the body part and is larger in dimension along the first direction than the body part. A part of the accommodation part faces the diaphragm of the loudspeaker unit.

A movable-body device according to the present disclosure includes a body, a drive unit, an amplifier, and the loudspeaker device described above. The drive unit and the amplifier are mounted in the body. The loudspeaker device is fed with an output from the amplifier.

DETAILED DESCRIPTION OF PREFERRED EMBODIMENTS

Prior to descriptions of embodiments of the present disclosure, problems of the conventional loudspeaker device will be briefly described. According to the loudspeaker device disclosed in Patent Literature 1, a spare-wheel housing section in the vehicle interior is used as an enclosure of a loudspeaker without any modification. This causes variations in acoustic characteristics because the volumetric capacity of the enclosure varies depending on the model of the automobile and the situation whether or not a tire is being housed in the housing section. Moreover, such a spare-wheel housing section essentially requires no airtightness; therefore, sounds will leak from the spare-wheel housing section. Therefore, the spare-wheel housing section is unsuitable for use as the volumetric capacity of the enclosure of the loudspeaker device.

Figure 1:
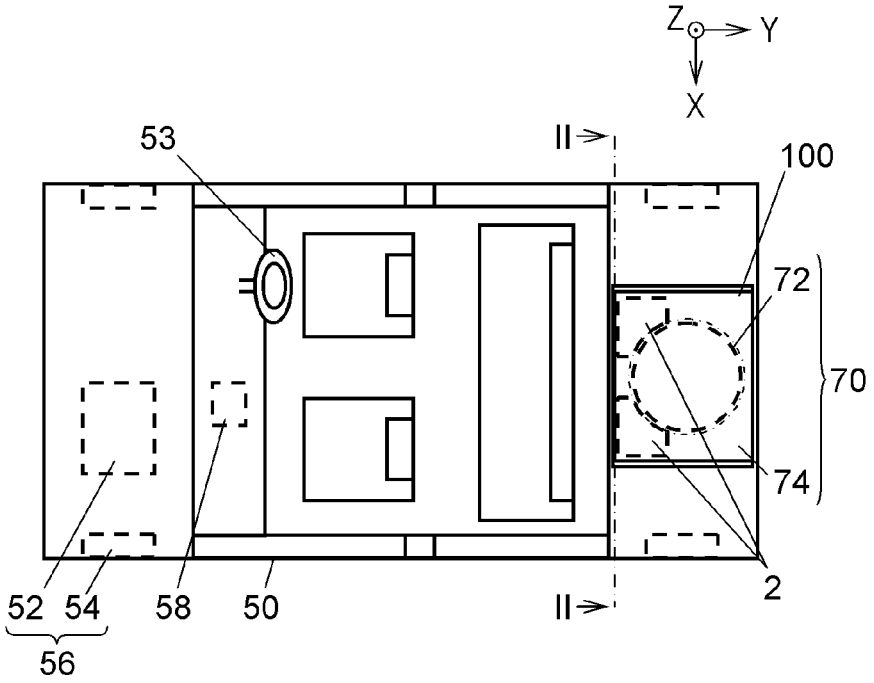
FIG. 1 is a top perspective view of an automobile equipped with a loudspeaker device according to an embodiment of the present disclosure.
Figure 2:
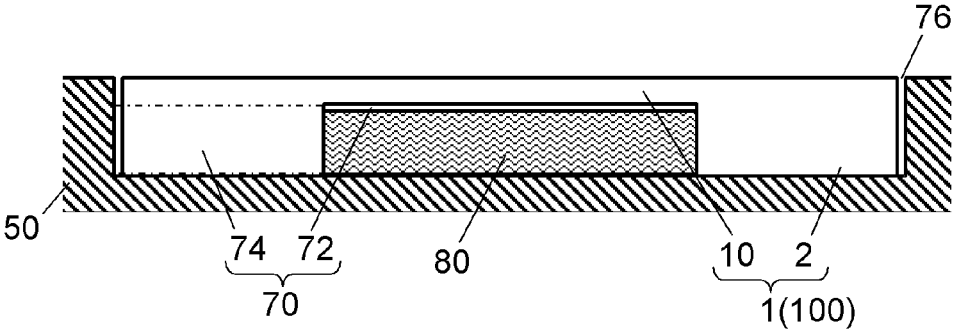
FIG. 2 is a cross-sectional view taken along line II-II of FIG. 1.
Figure 3:
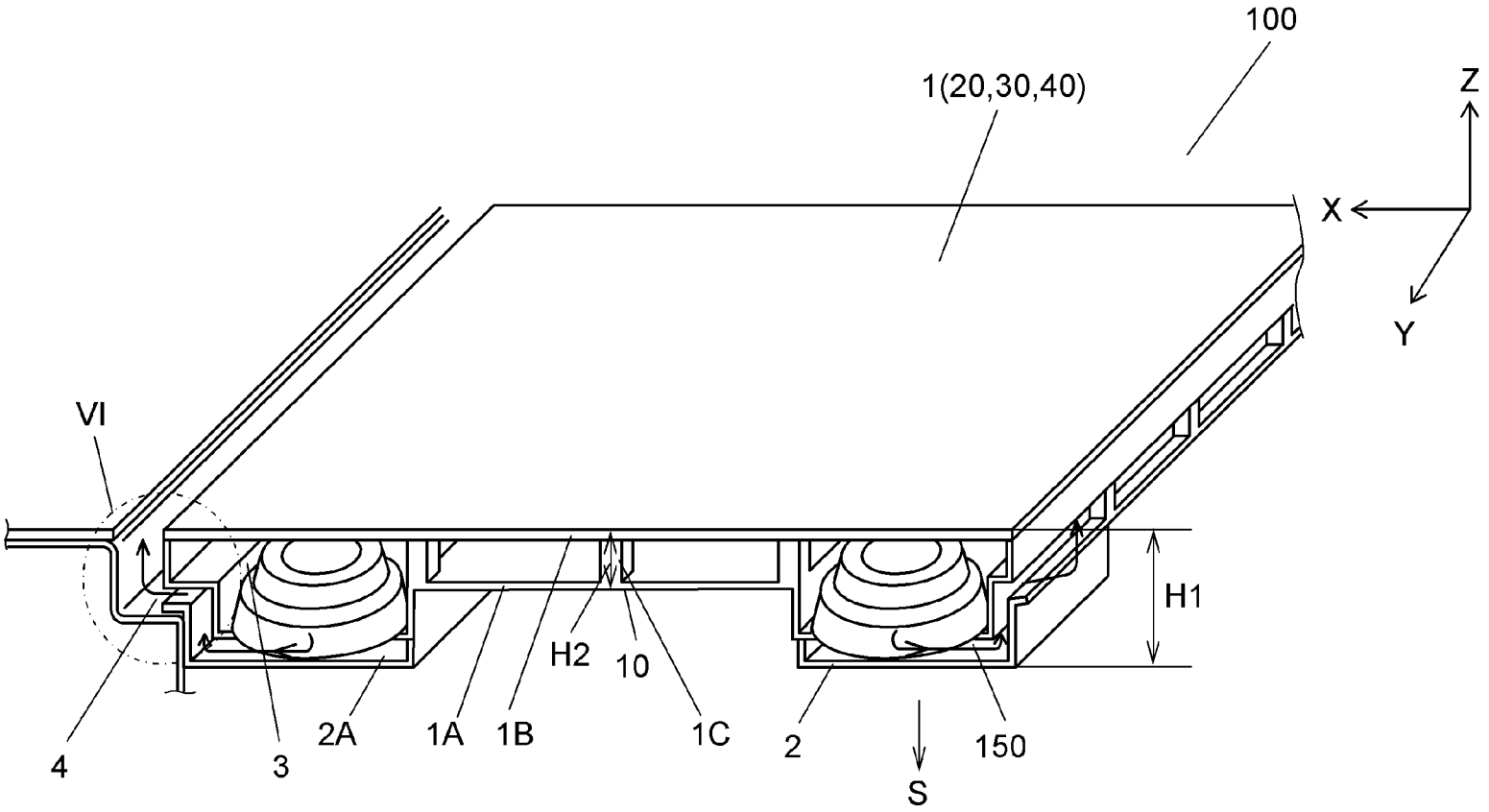
FIG. 3 is a partially cut-away perspective view of the loudspeaker device shown in FIG. 1.

Hereinafter, an embodiment of the present disclosure will be specifically described with reference to the accompanying drawings. FIG. 1 is a top perspective view of an automobile equipped with loudspeaker device 100 according to the embodiment of the present disclosure. FIG. 2 is a cross-sectional view taken along line II-II of FIG. 1. FIG. 3 is a partially cut-away perspective view of loudspeaker device 100. Loudspeaker device 100 is used for mainly reproducing deep bass sounds.

The automobile as an example of a movable-body device shown in FIG. 1 includes body 50, drive unit 56, amplifier 58, and loudspeaker device 100. Drive unit 56 includes drive source 52 and drive wheels 54. Drive source 52 includes at least one of an engine and a motor. Drive unit 56 may include steering wheel 53. Drive unit 56 and amplifier 58 are mounted in body 50. Loudspeaker device 100 is supplied with output from amplifier 58. Amplifier 58 may include a part of an audio system for use in the automobile. In this case, amplifier 58 may include such as a playback system for sound sources. Moreover, amplifier 58 may include a part of a car navigation system. In this case, amplifier 58 may include such as a display device.

As shown in FIGS. 1 and 2, in the rear part of body 50, housing section 70 having opening 76 is disposed. In this case, housing section 70 houses spare tire 80 for the automobile.

As shown in FIG. 3, loudspeaker device 100 includes loudspeaker units 150 and lid 1 of housing section 70. That is, loudspeaker units 150 are mounted in lid 1. Each of loudspeaker unit 150 receives electrical signals from amplifier 58 shown in FIG. 1 and outputs sounds mainly in first direction "S."

A part of lid 1 functions as enclosures 3 of loudspeaker units 150. In more detail, lid 1 includes body part 10, and accommodation parts 2 integrally formed with body part 10. Each of loudspeaker unit 150 is accommodated in accommodation part 2. Lid 1 covers opening 76 of housing section 70. Lid 1 is an example of an interior member of the automobile.

Commonly, housing section 70 is disposed in the bottom of a trunk or luggage room which is disposed in the rearward of rear sheets of the automobile. Lid 1 is disposed such that the space above it can be used as a trunk or a luggage room capable of housing baggage after housing section 70 has housed spare tire 80 therein. Accordingly, lid 1 is necessary for housing section 70. Moreover, the lid preferably has a plane shape in the upper side without projections and depressions, for efficiently housing baggage.

Note that, lid 1 is commonly configured with a plane-shaped resin molding. Most lids have surfaces having been subjected to processing, such as flocking, for enhancing their external appearance quality.

As shown in FIG. 2, housing section 70 includes first space 72 and second space 74. First space 72 is located under lid 1 and houses spare tire 80 therein. That is, first space 72 houses articles loaded in the automobile. On the other hand, in second space 74, accommodation parts 2 are disposed. In other words, on the periphery of accommodation part 2, first space 72 for housing the articles loaded in the automobile is disposed. In the example shown in FIGS. 1 and 2, first space 72 houses spare tire 80.

Spare tire 80 shown in FIG. 2 is held at a predetermined position with a nut and a bolt (not shown). The upper surface of spare tire 80 is covered with lid 1. Accommodation parts 2 are disposed in the lower face of lid 1 such that each of accommodation parts has a step height relative to body part 10. Loudspeaker units 150 are secured and accommodated in the inside of lid 1 (accommodation parts 2) such that loudspeaker units 150 can output sounds mainly in first direction "S." Dimension H1 along first direction "S" of each of accommodation parts 2 is larger than dimension H2 along first direction "S" of body part 10, so that loudspeaker unit 150 can be secured and accommodated in the inside of accommodation part 2. With such a shape of lid 1, it is possible to secure the requisite minimum thicknesses, that is, the requisite minimum thickness for using lid 1 as enclosure 3 and the requisite minimum thickness for securing loudspeaker unit 150 in the inside of lid 1. On the other hand, body part 10 is set to have a plane and thin shape; however, body part 10 has a so large area that the internal volume can be made sufficiently large as enclosure 3. If necessary, dimension H2 of body part 10 may be set somewhat larger, which will further increase the internal volume serving as enclosure 3, resulting in an increase in the ability of the device to reproduce deep bass sounds. Even with this configuration, lid 1 having the plane and thin shape undergoes only a slight increase in thickness as a whole, so that the loading capacity for baggage and the like is not remarkably restricted. Note that, in order to allow body part 10 to function sufficiently as a part of enclosure 3, accommodation parts 2 may communicate with body part 10.

For functioning as enclosure 3, lid 1 includes plane plates 1A and 1B, and a plurality of reinforcing ribs 1C. Plates 1A and 1B are disposed to have a space therebetween, and each of reinforcing ribs 1C connects plate 1A to plate 1B. This configuration securely provides the space in the inside of lid 1. The dimension along first direction "S" of each of reinforcing ribs 1C is 3 cm to 4 cm, for example.

Lid 1 includes accommodation parts 2, allowing lid 1 to function as enclosure 3 of loudspeaker devices 100. Therefore, such an empty space which would not be used in the vehicle interior can be effectively utilized as enclosure 3. On top of that, it is possible to secure a sufficient internal volume of enclosure 3, resulting in an increase in quality of acoustic characteristics of the vehicle interior. Moreover, it is possible to reduce variations in acoustic characteristics depending on the model of the automobile, and to reduce a leakage of sounds and the like.

Accommodation part 2 not only secures and accommodates loudspeaker unit 150 therein, but also provides an acoustic space for sounds radiated from loudspeaker unit 150. For a sound radiated in the front direction (first direction "S") of loudspeaker unit 150 and a sound radiated in the rear direction of loudspeaker unit 150, enclosure 3 also has a role in acoustically intercepting these sounds from each other, which prevents these sounds from cancelling each other, thereby preventing a reduction in their sound pressures.

Note that lid 1 may further include duct part 4 that connects accommodation part 2 to the vehicle interior (an example of the inside of the movable-body device). Generally, the larger the volume of an acoustic space is, the smaller the sound radiation resistance becomes, tending to provide better acoustic characteristics. The sound radiated in the inside of accommodation part 2 travels, through duct part 4, toward the upper side of lid 1 (in the positive direction of the Z-axis shown in FIG. 3). Even in cases of loudspeaker unit 150 being secured and accommodated in accommodation part 2, the presence of duct part 4 allows the sound to be efficiently radiated in the vehicle interior without reduction in sound pressure.

As shown in FIG. 3, loudspeaker unit 150 is secured such that the rear face of loudspeaker unit 150 faces the inside of enclosure 3. The sound radiated in the rear direction is intercepted by enclosure 3 so as not to be radiated in the vehicle interior. In contrast, the sound radiated in the front direction (first direction "S") propagates through duct part 4 to the inside of the vehicle interior. Duct part 4 is configured such that the sound radiated in the front direction from loudspeaker unit 150 can travel through duct part 4 so as to propagate opposite to the front direction. Note that duct part 4 may extend in a direction other than the rear direction, excluding the front direction. In other words, duct part 4 extends in the direction different from first direction "S."

Duct part 4 is configured in this way, so that sound waves with short wavelengths in a high frequency range are attenuated and sound waves with long wavelengths in a low frequency range can be selectively taken out. Therefore, duct part 4, having such a shape, can function as a mechanical filter, which allows sounds in a middle- to high-tone range to be naturally attenuated without use of a network circuit or an equalizer circuit. Accordingly, sound waves containing deep bass sounds reproduced with high fidelity reach passengers present in the vehicle interior. The passengers can enjoy music and the like with high sound quality particularly regarding deep bass sounds. At the same time, of course, middle to high-pitched sounds other than the deep bass sounds are reproduced by already-existing speakers. Such already-existing speakers are often disposed in doors, a rear tray, or in the vicinity of an instrument panel in the front. Then, resulting from the effect of duct part 4 as described above, middle to high-pitched sounds output from loudspeaker unit 150 are not radiated directly into the vehicle interior. This prevents sound waves in a high frequency range emitted from different speakers from causing interference between them that would reduce sound quality.

As shown in FIG. 3, duct part 4 is disposed at an outer peripheral portion of lid 1. With this configuration, the sound waves radiated from duct part 4 propagate along wall surfaces of the vehicle interior, resulting in an efficient propagation of the sound to the passengers. Moreover, this can reduce the occurrence of undesired resonances. Therefore, for deep bass sounds with long wavelengths, sound pressures do not decrease before the sounds reach passenger's ears, resulting in the presentation of high quality sounds.

Note that loudspeaker unit 150 mainly reproduces deep bass sounds. That is, the major reproduction range of loudspeaker unit 150 is 300 Hz or less. Loudspeaker unit 150 of this type is generally called a woofer. Moreover, a so-called super woofer for a major reproduction range of 100 Hz or less may be equipped as loudspeaker unit 150. Such deep bass sounds can be provided even without duct part 4, through vibrations of lid 1 as a whole. Therefore, duct part 4 is not always essential in accordance with applications.

Figure 4:
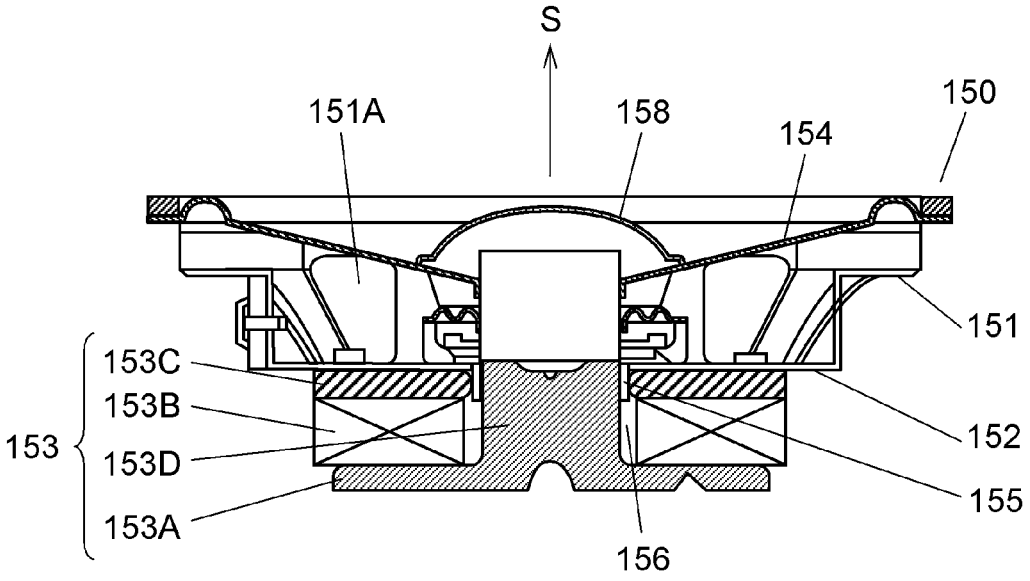
FIG. 4 is a cross-sectional view of a loudspeaker unit of the loudspeaker device shown in FIG. 3.

FIG. 4 is a cross-sectional view of loudspeaker unit 150. In FIG. 4, loudspeaker unit 150 is illustrated such that the front face thereof is positioned up while the rear face positioned down. As described above, loudspeaker unit 150 is a speaker unit for exclusive use in reproducing sounds in a low-tone range.

Loudspeaker unit 150 includes frame 151, supporting part 152, magnetic circuit 153, diaphragm 154, and voice coil 155. Supporting part 152 is disposed in a center portion of frame 151. Magnetic circuit 153 of an outer magnet-type is provided with magnetic gap 156. The front face of magnetic circuit 153 is bonded to the rear face of supporting part 152. The outer peripheral end of diaphragm 154 is coupled to the outer peripheral end portion of frame 151. A first end portion of voice coil 155 is bonded to a center portion of diaphragm 154. Then, a second end portion of voice coil 155 is inserted into magnetic gap 156. Note that, as shown in FIG. 3, bottom plate 2A being a part of accommodation part 2 faces diaphragm 154.

Loudspeaker unit 150 may include dust cap 158. In this case, dust cap 158 is bonded to the center portion of diaphragm 154. Then, dust cap 158 protrudes from the front face of diaphragm 154. Moreover, frame 151 is preferably provided with holes 151A. In this case, sounds output from the rear face of diaphragm 154 pass through holes 151A to be output to the outside of loudspeaker unit 150. Loudspeaker unit 150 works in such a way that voice coil 155 vibrates to cause diaphragm 154 to vibrate, thereby outputting sounds in both the forward and backward directions of loudspeaker unit 150. The vibration of voice coil 155 is caused by a magnetic force generated by magnetic circuit 153.

Magnetic circuit 153 includes yoke 153A, magnet 153B, upper plate 153C, and center pole 153D. Note that center pole 153D is a projection formed in a center portion of yoke 153A. Upper plate 153C is bonded to the front face of magnet 153B. Magnet 153B is bonded to the front face of yoke 153A. Accordingly, the front face of upper plate 153C is bonded to the rear face of supporting part 152. Note that center pole 153D passes through a hole that is formed in both the center portion of magnet 153B and the center portion of upper plate 153C. With this configuration, magnetic gap 156 is formed in a region where upper plate 153C faces center pole 153D.

As shown in FIGS. 2 and 3, in the negative direction of the Z-axis (first direction "S"), lid 1 is provided with housing section 70 (tire house) for housing spare tire 80 as well as accommodation parts 2. After spare tire 80 has been housed in first space 72 of housing section 70, there exists an empty space, as a surplus space, around spare tire 80 in housing section 70. The surplus space corresponds to second space 74. To effectively utilize the surplus space, at least one accommodation part 2 is disposed in the surplus space. Disposing accommodation part 2 in this way allows the empty space, which would not be originally utilized, to be effectively used such that the space can house a part of enclosure 3, thereby securing the volumetric capacity of enclosure 3.

Figure 5:
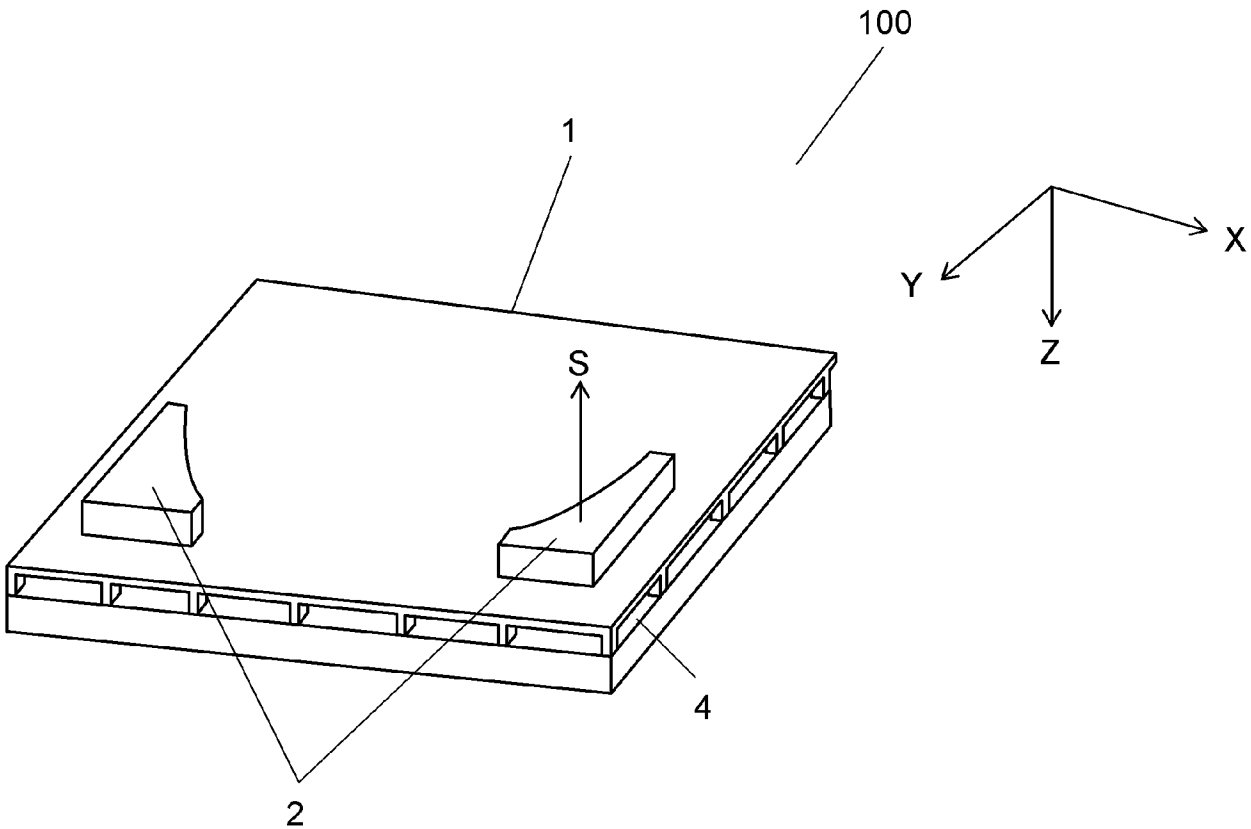
FIG. 5 is a rear perspective view of the loudspeaker device shown in FIG. 3.

FIG. 5 is a rear perspective view of lid 1. Accommodation part 2 may have a side face (herein after referred as "inner side face") on the inner side of lid 1 which is one of interior members of the automobile, and the inner side face may have a circular arc shape as viewed from the opposite direction of first direction "S." By causing the inner side face of accommodation part 2 to take a circular arc shape, accommodation part 2 can be disposed along the contour of spare tire 80 shown in FIG. 2. Accordingly, accommodation part 2 can be disposed in second space 74, i.e. the surplus space which exists after spare tire 80 has been housed. This makes it possible to secure a sufficient volumetric capacity of enclosure 3, resulting in a further increase in sound quality with loudspeaker device 100.

Note that, as shown in FIGS. 1 to 3, and 5, loudspeaker device 100 includes two of loudspeaker units 150 and two of accommodation parts 2. Accommodation parts 2 house loudspeaker units 150, respectively. Then, each of accommodation parts 2 is configured such that the side face (inner side face) on the inner side of lid 1 takes a part of a circular arc shape as viewed from the opposite direction of first direction "S." Moreover, the inner side face of each of accommodation parts 2 at two positions is of a circular arc shape, and the inner side face of each of accommodation parts 2 is a corresponding part of an identical circle. Arranging the two of accommodation parts 2 in this way allows accommodation parts 2 to be disposed in second space 74, i.e. the surplus space which exists after spare tire 80 has been housed. This makes it possible to secure the sufficient volumetric capacity of enclosure 3, resulting in a further increase in sound quality with loudspeaker device 100. Moreover, appropriately setting the thickness of accommodation parts 2 brings about ease of housing of lid 1 at the peripheral portion, i.e. second space 74, of spare tire 80.

Note that, in the embodiment, the two of accommodation parts 2 are disposed; however, the number of accommodation parts 2 is not limited to two. A plurality, more than two, of accommodation parts 2 may be disposed in lid 1 and that loudspeaker units 150 identical in number to accommodation parts 2 are accommodated in accommodation parts 2, one for each. In this case as well, it is only required for the plurality of accommodation parts 2 to be configured such that the inner side face of each of accommodation parts 2 is of a circular arc shape and the inner side face forms a corresponding part of an identical circle, as viewed from the opposite direction of first direction "S." That is, three of accommodation parts 2 may be disposed in lid 1 or, alternatively, four of accommodation parts 2 may be disposed. For example, when accommodation parts 2 are disposed at four positions around the periphery of spare tire 80, a sufficient volumetric capacity for enclosure 3 can be ensured and accommodation parts 2 function as a guide for supporting spare tire 80 not to move. Note that, in general, sounds of music and the like are reproduced in stereo. In such applications, an even number of loudspeaker units 150 are disposed in the same even number of accommodation parts 2, respectively.

Moreover, in a case where a super woofer is used as loudspeaker unit 150, it may not be required that bass sounds be reproduced in stereo. In such applications, one loudspeaker unit 150 is disposed in one accommodation part 2.

Figure 6:
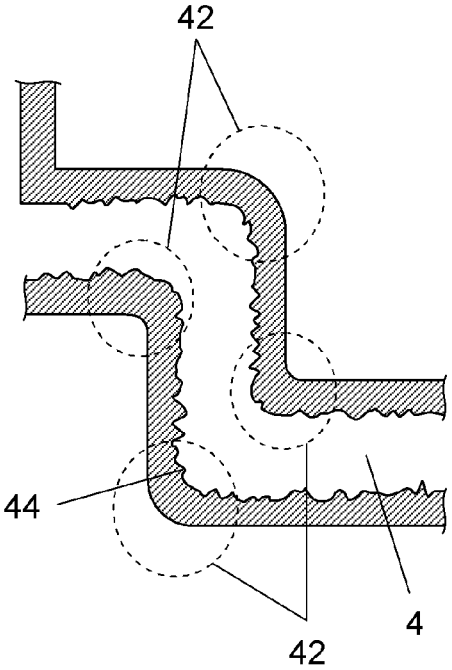
FIG. 6 is an enlarged cross-sectional view of a portion shown in FIG. 3.

Note that duct part 4 shown in FIG. 3 is such that its inner wall is configured with a combination of planes (plane plates). Such a configuration provides ease of combination of the inner wall with other components that configure the interior of the automobile, leading to ease of installing of duct part 4 into loudspeaker device 100. However, the cross section of the inner wall of duct part 4 is not limited to such a straight-line shape. A part of the inner wall of duct part 4 may be configured with a curved surface. Such a configuration is now described with reference to FIG. 6. FIG. 6 is an enlarged cross-sectional view of portion VI shown in FIG. 3.

Parts of the section of the inner wall of duct part 4 shown in FIG. 6 are formed in curved line shapes. Specifically, the inner wall of duct part 4 includes bending parts 42 each of which is configured with a curved surface. In the case where bending parts 42 are of gently curved surfaces as illustrated, it is possible to prevent occurrence of air strain due to acoustic radiation at sharp curvature-changing points, causing acoustic distortion to be less prone to occur. As a result, loudspeaker device 100 can reproduce sounds with high quality. Moreover, uneven surface 44 may be formed on at least bending parts 42 of the inner wall of duct part 4. At bending parts 42 configured with curved surfaces, the rounding of the inner wall causes the velocity of an air stream to change, leading to an increase in velocity. Uneven surface 44 has a function of regulating the air stream. Disposing uneven surface 44 on the inner wall of duct part 4 for the purpose of regulating the air stream allows a reduction in harmonic distortions caused by air turbulence. Note that uneven surface 44 may be disposed on portions, other than bending parts 42, of the inner wall of duct part 4. Uneven surface 44 may be formed on at least a part of the inner wall of duct part 4, even in cases of the configuration in which duct part 4 includes no bending part 42.

Moreover, the depth (the distance between the highest and lowest points on the surface in the direction of thickness of the inner wall) of uneven surface 44 is preferably in a range from 0.5 mm to 2 mm, inclusive. With heights smaller than 0.5 mm, the function of regulating an air stream is restricted. With heights exceeding 2 mm, there are cases where uneven surface 44 becomes a factor in causing air strain.

The configuration described above provides loudspeaker device 100 that features compatibility between the high sound quality in an vehicle interior and the efficient use of the space of the vehicle interior. In the embodiment, lid 1 has been described as an example of the interior member functioning as enclosure 3, of the automobile; however, the interior member is not limited to this. In FIG. 3, lid 1 may be replaced with another part. Examples of another part includes bottom plate 20 of the luggage room, lid 30 of a box for holding small miscellaneous accessories or other small articles, and the like. Moreover, in a case where the movable-body device is an electric vehicle, a hybrid vehicle, etc., lid 1 may be replaced with lid 40 of a battery storage space or the like. Into any one of these interior members, loudspeaker unit 150 may be installed. Moreover, since such a battery storage space is often disposed below the luggage room or below the rear sheets, lid 40 may also serve as bottom plate 20 of the luggage room or, alternatively, may be disposed at another place.

As described above, installing loudspeaker device 100 into a movable-body device such as an automobile allows the effective utilization of a surplus space in the interior of the movable-body device, and provides the sufficient volumetric capacity of enclosure 3. This can provide the movable-body device that achieves high sound quality in the interior thereof.

Therefore, it is possible to implement the movable-body device that achieves high sound quality in the interior thereof, without any increase in cost for extra members and in weight accompanying the extra members.

On top of that, since enclosure 3 of loudspeaker device 100 is configured utilizing an interior member of an automobile or the like, the need for introducing additional members is eliminated for configuring enclosure 3. This can achieve a reduction in count and weight of its parts simultaneously, which in turn achieves low price and fuel saving, via reduced weight, of the automobile or the like.

As described earlier, according to Patent Literature 1, a space such as a spare-wheel housing section is used; however, the space essentially requires no airtightness. This causes a sound leakage, resulting in a decrease in sound quality. On the other hand, although loudspeaker device 100 is configured using an interior member of an automobile, loudspeaker device 100 is completed as an acoustic system by itself. For this reason, this reduces such a decrease in sound quality as observed in the case of Patent Literature 1.

As described above, the loudspeaker device according to the present disclosure is useful for use in vehicles. Note that the movable-body device is not limited to an automobile. The loudspeaker device according to the present disclosure is applicable to movable-body devices, such as a ship and a train, each of which has a space therein where sounds are output.

What is claimed is:

1. A loudspeaker device used in a movable-body device including a space for housing a spare tire and a lid for closing the space, the loudspeaker device comprising:

a plurality of loudspeaker units each including a diaphragm for outputting a sound mainly in a first direction upon receiving an electric signal; and an enclosure configured with at least a part of the lid of the movable-body device, the enclosure securing and accommodating the plurality of loudspeaker units in an inside of the enclosure, wherein the enclosure includes:

a body part;

a plurality of accommodation parts accommodating the plurality of loudspeaker units, respectively, being formed integrally with the body part, and being larger in dimension along the first direction than the body part, the plurality of accommodation parts being equal in number to the plurality of loudspeaker units; and a plurality of duct parts extending from the plurality of accommodation parts toward the lid, respectively, wherein each of the plurality of accommodation parts includes:

a plate facing the diaphragm in the first direction so as to face the diaphragm; and an acoustic space enclosed by one of the plurality of loudspeaker units and the plate, wherein the plate is configured to propagate sound outputted from the diaphragm in the first direction toward a corresponding one of the plurality of duct parts in a direction different from the first direction, and each of the plurality of duct parts connects the acoustic space and an inside of the movable-body device, each of the plurality of the accommodation parts includes a side face on an inner side of the the lid, the side face has a circular arc shape as viewed from an opposite direction to the first direction, and the side face of each of the plurality of the accommodation parts forms a part of an identical circle as viewed from the opposite direction.

2. The loudspeaker device according to claim 1, wherein each of the plurality of duct parts extends in a direction different from the first direction.

3. The loudspeaker device according to claim 1, wherein the plurality of duct parts are disposed along an outer peripheral portion of the enclosure.

4. The loudspeaker device according to claim 1, wherein each of the plurality of duct parts includes a bending part configured with a curved surface.

5. The loudspeaker device according to claim 4, wherein an inner wall of the bending part of each of the plurality of duct parts includes an uneven surface.

6. The loudspeaker device according to claim 1, wherein a number of the plurality of the accommodation parts and a number of the plurality of the loudspeaker units are an equal even number.

7. The loudspeaker device according to claim 1, wherein a major reproduction range of each of the plurality of loudspeaker units is 300 Hz or less.

8. The loudspeaker device according to claim 1, wherein a major reproduction range of each of the plurality of loudspeaker units is 100 Hz or less.

9. The loudspeaker device according to claim 1, wherein the plurality of accommodation parts communicate with the body part.

10. A movable-body device comprising:

a body;

a drive unit mounted in the body;

an amplifier mounted in the body; and a loudspeaker device according to claim 1, the loudspeaker device being fed with an output from the amplifier.

11. The movable-body device according to claim 10, wherein the body includes a housing section having an opening;

the enclosure of the loudspeaker device covers the opening of the housing section; and the housing section includes:

a first space for housing the spare tire; and a second space in which the plurality of accommodation parts of the enclosure of the loudspeaker device is disposed.

* * * * *